US006102754A

United States Patent [19]

Capper et al.

[11] Patent Number: 6,102,754

[45] **Date of Patent: *Aug. 15, 2000**

[54] BUS BAR CONTACT

[75] Inventors: Harry Milton Capper; Brian Frank Jacobeen; James William Robertson, all of Harrisburg, Pa.

[73] Assignee: The Whitaker Corporation, Wilmington, Del.

[ * ] Notice: This patent issued on a continued prosecution application filed under 37 CFR 1.53(d), and is subject to the twenty year patent term provisions of 35 U.S.C. 154(a)(2).

[21] Appl. No.: 08/828,871

[22] Filed: Mar. 31, 1997

[51] Int. Cl.[7] ..... H01R 11/22

[52] U.S. Cl. ..... 439/857; 439/517

[58] Field of Search ..... 439/517, 856, 439/857, 861–863

[56] References Cited

U.S. PATENT DOCUMENTS

| | | | |
|---|---|---|---|
| 3,865,462 | 2/1975 | Cobaugh et al. . | |
| 4,037,915 | 7/1977 | Cabaud . | |
| 4,257,668 | 3/1981 | Ellis, Jr. . | |
| 4,384,754 | 5/1983 | Douty et al. . | |
| 4,684,191 | 8/1987 | Feher et al. | 439/246 |
| 4,717,361 | 1/1988 | Igarashi et al. | 439/856 |
| 4,740,180 | 4/1988 | Harwath et al. | 439/856 |
| 4,820,182 | 4/1989 | Harwath et al. | 439/290 |
| 4,869,673 | 9/1989 | Kreinberg et al. | 439/64 |
| 4,887,976 | 12/1989 | Bennett et al. | 439/492 |
| 4,892,485 | 1/1990 | Patton | 439/167 |
| 4,944,691 | 7/1990 | Marach | 439/516 |
| 4,944,692 | 7/1990 | Allina | 439/517 |
| 5,024,610 | 6/1991 | French et al. | 439/857 |
| 5,129,841 | 7/1992 | Allina et al. | 439/517 |
| 5,334,057 | 8/1994 | Blackwell | 439/839 |

*Primary Examiner*—Khiem Nguyen
*Attorney, Agent, or Firm*—Michael Aronoff

[57] ABSTRACT

The invention is directed to a bus bar contact having a body with two mating ends. One of the mating ends has a tab contact portion. The other of the mating ends having a receptacle contact portion. The receptacle contact portion has a plurality of resilient fingers for providing an electrical interface. The resilient fingers are stamped and formed from the body member wherein adjacent resilient fingers are sheared from each other thereby removing no material from between the adjacent resilient fingers.

5 Claims, 3 Drawing Sheets

BUS BAR CONTACT

BACKGROUND OF THE INVENTION

The invention is directed to a bus bar contact having a tab contact on one end and a receptacle contact on the other end.

FIELD OF THE INVENTION

Bus bar contacts are often used in power meters to provide and monitor power to the premises with electrical power from the supplier. U.S. Pat. No. 5,334,057 shows an electrical connector having a receptacle and a tab portion. The receptacle is designed to receive a mating blade member of a bus bar therein to provide electrical connection therewith. The receptacle portion of the contact is made up of several pieces of metal in addition to the main blade of the contact. A resilient arm is mounted along the side of the main blade portion and a spring is mounted over the blade portion and the resilient arm to provide a biasing force to urge contact faces together and to provide a large contact force against a mating blade contact.

Similarly, U.S. Pat. Nos. 4,892,485 and 4,944,692 both show bus bar contacts wherein the receptacle portion of the bus bar is formed by having a separate piece forming a resilient finger mounted along the side of the blade contact to provide the receptacle contact.

By having multiple pieces form the bus bar contact, multiple points of resistance are established.

What is needed is a bus bar contact which will provide less resistance for supplying power to the consumer.

SUMMARY OF THE INVENTION

The invention is directed to a bus bar contact having a body with two mating ends. One of the mating ends has a tab contact portion. The other of the mating ends has a receptacle contact portion. The receptacle contact portion has a plurality of resilient fingers for providing an electrical interface. The resilient fingers are stamped and formed from the body member wherein adjacent resilient fingers are sheared from each other thereby removing no material from between the adjacent resilient fingers.

The invention is further directed to a bus bar contact having an integral body with a receptacle portion extending in one direction and a tab portion extending in an opposite direction. The receptacle portion has a plurality of resilient fingers forming a mating slot therebetween. Adjacent ones of the resilient fingers are disposed on opposite sides of the mating slot. The adjacent resilient fingers are sheared from each other during formation thereby removing no material from between the adjacent resilient fingers.

BRIEF DESCRIPTION OF THE DRAWINGS

Embodiments of the present invention will now be described with reference to the accompanying drawings, in which.

DETAILED DESCRIPTION OF AN EMBODIMENT OF THE INVENTION

Figure 3:
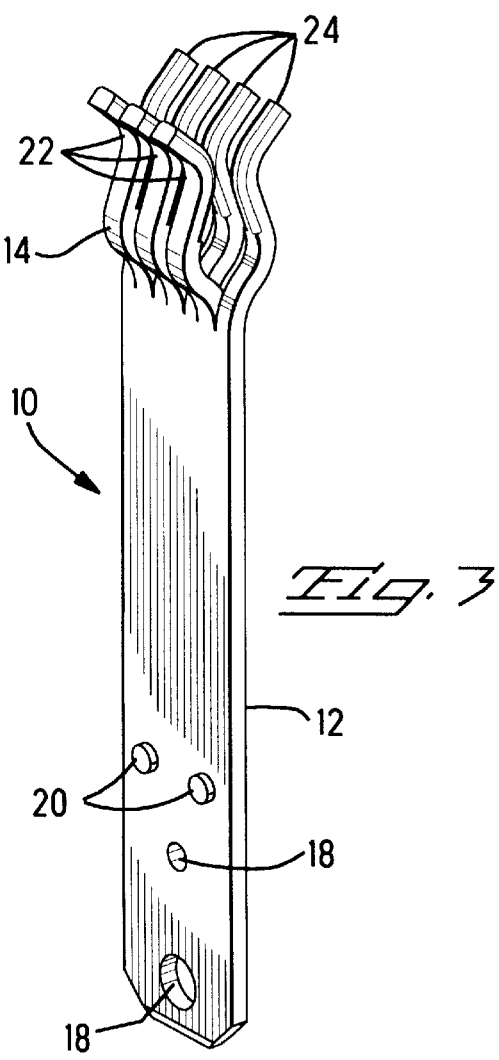
FIG. 3 is an isometric view of the bus bar.

FIGS. 1–4 show a first embodiment of the bus bar contact of the present invention. The bus bar contact 10 is used to provide electrical power in an electrical meter. The bus bar contact 10 has a tab contact portion 12 and a receptacle portion 14. The bus bar contact is a one piece contact. The receptacle portion and the blade portion of the contact 10 are all one integral piece. The bus bar contact 10 is formed from one piece of metal, such as a high strength copper alloy, for example CDA 151, wherein the receptacle portion 14 and the tab portion 12 is stamped and formed from a single piece of metal.

The blade portion 12 is designed to be received in a mating receptacle connector to provide electrical connection thereto. The blade portion 12 has recesses 18 and protrusions 20. These recesses 18 and protrusions 20 serve to provide alignment and latching features to the mating receptacle connector for the blade portion 12. Other features may be included on the blade portion 12 to provide securing or aligning features as needed for a specific use of the contact 10.

The receptacle portion 14 has a series of resilient fingers 22, 24. The resilient fingers 22, 24 are separated from each other thereby forming a slot 26 into which a mating blade contact is received to provide electrical connection. Adjacent resilient fingers 22, 24 are disposed along opposite sides of the slot 26. The resilient fingers 22, 24 each have protrusions 28 along a mating surface along the slot 26 to provide good electrical connection with the mating blade contact. The resilient fingers 22, 24 are stamped and formed from the integral piece which forms the bus bar contact 10.

Figure 2:
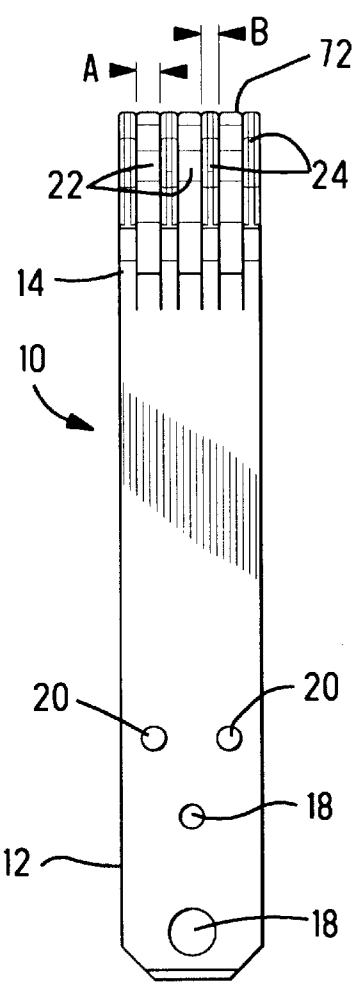
FIG. 2 is a front view of the bus bar.
Figure 1:
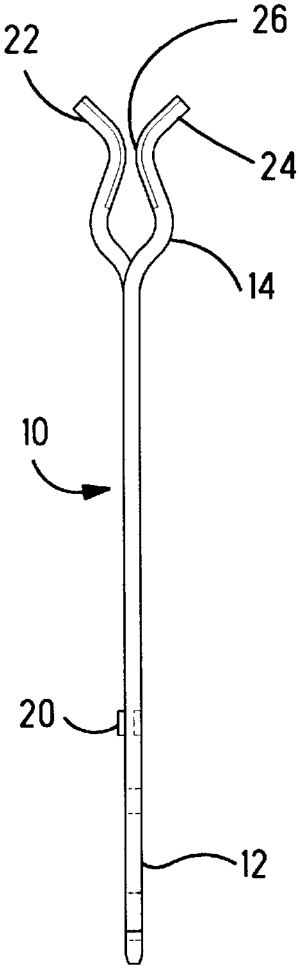
FIG. 1 is a side view of the bus bar contact of the present invention.
Figure 4:
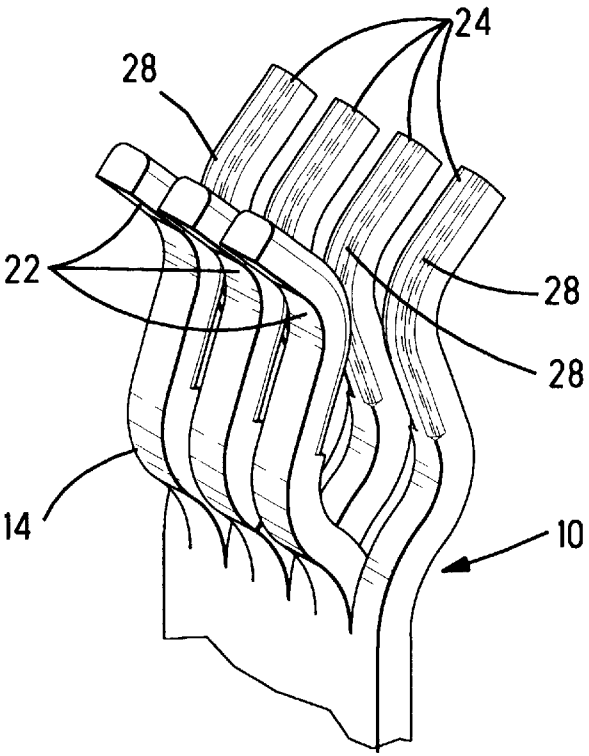
FIG. 4 is an enlarged view of the contact fingers of the bus bar.

As shown in FIG. 2, the resilient fingers 22, 24 are sheared from each other during the forming process so that there is no material removed from between the adjacent resilient fingers 22, 24 such that the side edges of successive ones of the fingers are coplanar with no gap therebetween as seen in FIG. 2, since no material was removed in the shearing process. Also, as seen in FIG. 2, the side edges of the body between the receptacle and blade portions are parallel. This provides for the same amount of material along the receptacle contact interface as is used for the rest of the blade contact 10, defining a constant conductive and blade portions. Furthermore, as can be seen in FIGS. 2–4, in this embodiment of the bus bar contact seven resilient fingers 22, 24 are provided to provide good electrical contact with the mating blade. Furthermore, as can be seen in FIG. 2, resilient fingers 22 are slightly wider than the resilient fingers 24. This can be seen at A wherein the width of the resilient fingers 22 is shown and at B wherein the width of the resilient fingers 24 are shown. Because an odd number of resilient fingers are formed, the width of the resilient fingers on one side of the contact are made slightly wider than the width of the resilient fingers on the other side of the contact, thereby balancing the amount of material, and therefore the force, on the opposite sides of the mating blade connector. The combined total width of the resilient fingers 24 on one side of the mating slot 26 is equal to the combined total width of the resilient fingers 22 on the other side of the mating slot 26, thereby balancing the force on either side of the mating tab contact.

Alternatively, the contact can have an even number of resilient fingers. If the resilient fingers are disposed in a similar alternating pattern along the slot, a bending force will be transmitted to the mating blade connector. This may be fine if the mating blade contact can tolerate the bending force. However, if the mating blade contact cannot tolerate the bending force, in order to avoid that bending force, the two center most resilient fingers may be disposed on the same side of the slot, and the resilient fingers are arranged in an alternating pattern extending from the center most fingers towards the outer portions of the contact. Since there is an equal number of resilient fingers on either side of the slot, the width of each of the resilient fingers would be the same, thereby providing an equal force on both sides of the mating blade connector.

Figure 6:
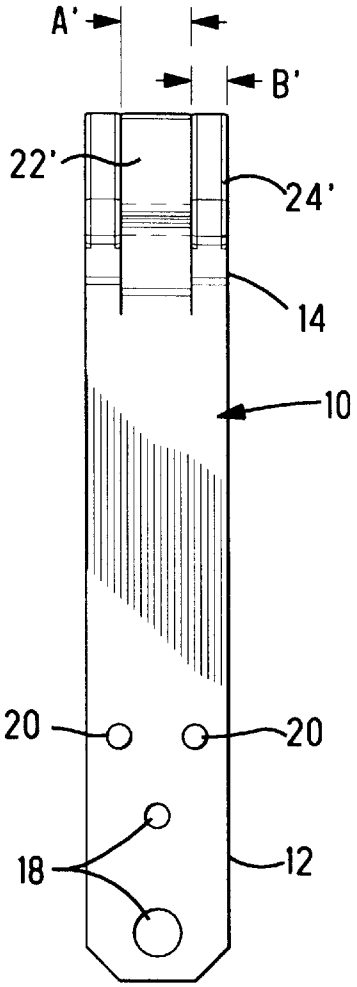
FIG. 6 is a front view of the bus bar FIG. 5.
Figure 5:
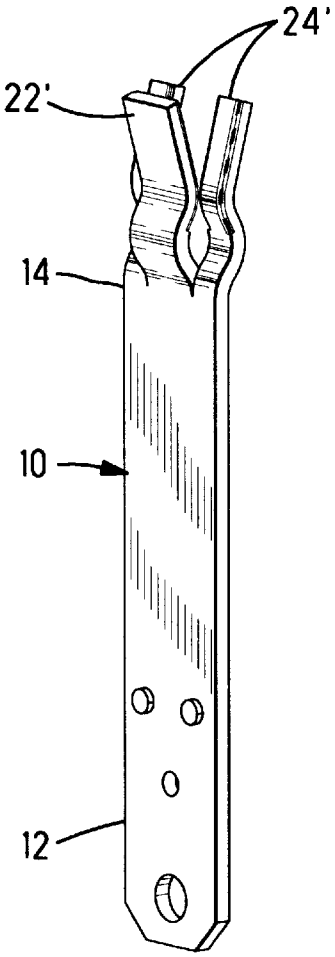
FIG. 5 is an isometric view of a third embodiment of the present invention.

FIGS. 5–6 show an alternative embodiment of the bus bar contact 10 of the present invention. The bus bar contact shown in FIGS. 5 and 6 is essentially identical that shown in FIG. 1–6, however the bus bar contact shown in FIG. 5 has only 3 resilient fingers 22', 24'. As can be seen in FIG. 6, the central resilient finger 22' is significantly wider than the outer resilient fingers 24', A' indicates the width of the resilient finger 22' and B' represents the width of the resilient fingers 24'. The width of A' is equal to the combined widths of B' thereby providing an equal amount of force on opposite sides of the mating contact.

Figure 7:
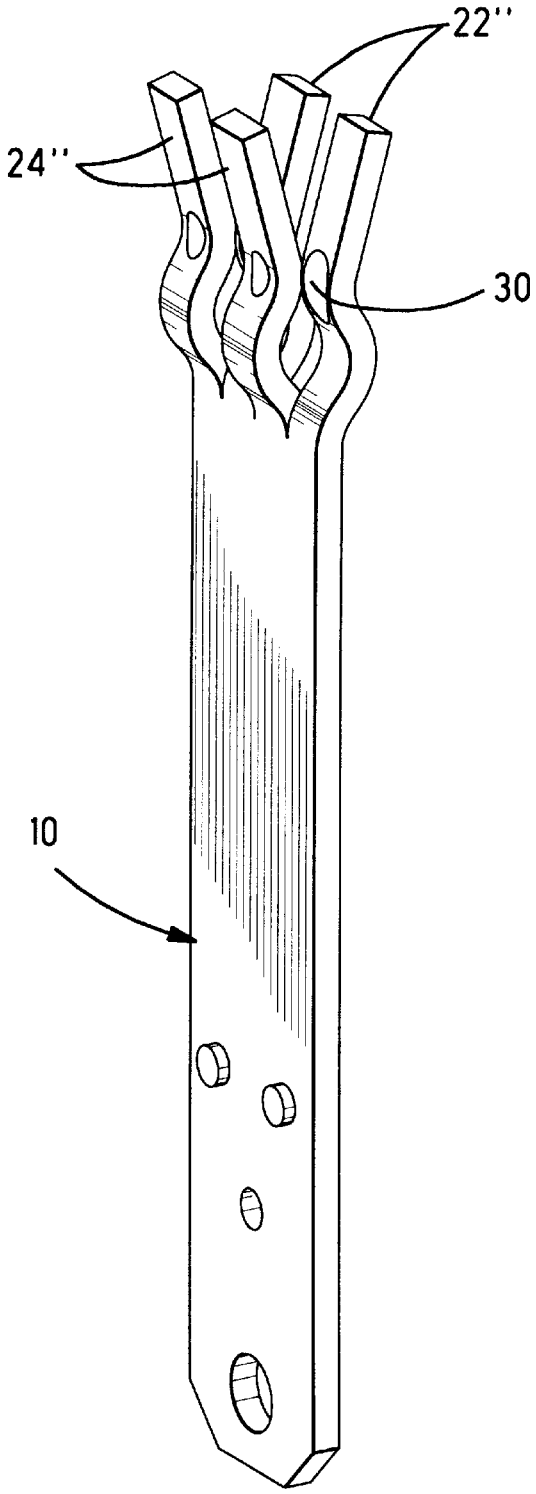
FIG. 7 is an isometric view of an alternative embodiment of the present invention.
Figure 8:
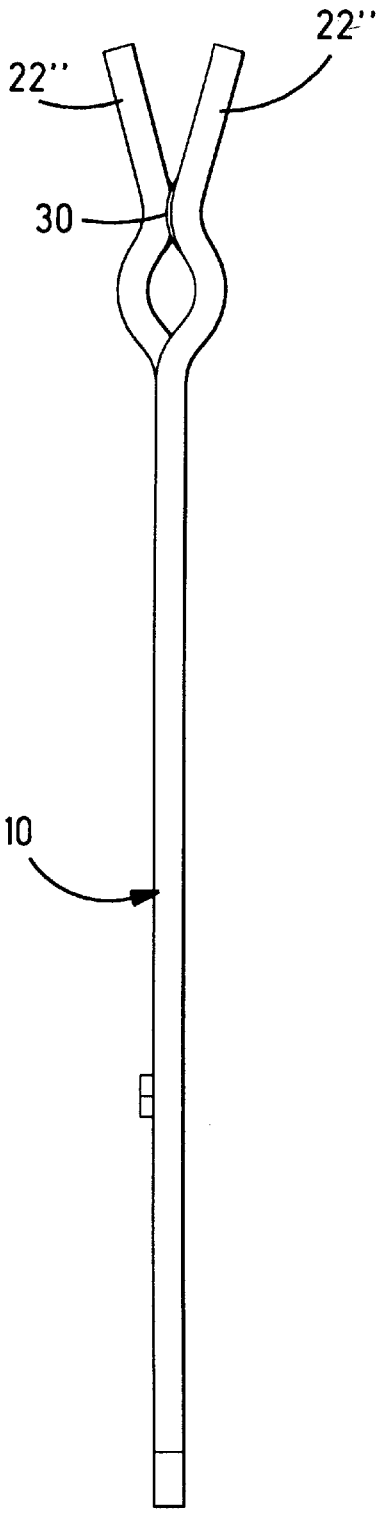
FIG. 8 is a side view of the bus bar contact of FIG. 7.

FIGS. 7 and 8 show an alternative embodiment of the bus bar contact 10 of the present invention. The bus bar contact 10 has an even number of resilient fingers 22", 24" which are disposed in an alternating pattern across the mating interface. The bus bar contact 10 in FIGS. 7 and 8 have contact protrusions 30 disposed along the mating surface of the resilient fingers 22", 24". The contact protrusions 30 are stamped and formed during the forming process for the contact 10. An advantage of having the contact protrusions 30 along the mating surface is that one does not need to worry about the sharp sheared edges along the sides of the resilient fingers 22", 24". If the sharp sheared edges have burrs, they will not engage, and thereby damage, the mating blade contact because the contact protrusions 30 will engage the mating blade contact.

In addition, the contact 10 shown in FIGS. 7 and 8 has a negative width mating slot 26". The resilient fingers 22", 24" are arranged so that their mating surfaces extend beyond each other along the mating slot 26", thereby requiring that the resilient fingers 22", 24" must be deflected during the insertion of even the smallest mating blade contact. In this embodiment, there is a higher contact normal force on the mating blade contact. However, there is also a higher insertion force for the mating blade contact.

The bus bar contact 10 of the different embodiments are made by shearing and forming the resilient fingers. These fingers make contact across the width of the mating blade at multiple locations, in which they act as parallel circuit paths. It is known from past experience that connectors with multiple contact locations have better electrical performance than designs which have only one. By connecting to the mating blade at multiple locations across the width, and alternating the face of the blade that adjacent contact fingers make contact to, the constriction resistance at the separable contact interface is minimized.

An advantage of disclosed embodiments of the present invention is that the fingers are made by shearing without removal of metal therebetween. This results in several benefits. Firstly, because there is no material removed, the current flux path through the fingers at the root of the beam is undisturbed, and the constriction resistance is virtually eliminated. Secondly, by utilizing the full geometry of the contact beams with this configuration, the bulk resistance per unit length of the beam through the finger area is the same as other locations along the bus bar contact which minimizes the bulk resistance. Finally, the bus bar contact is easy to manufacture and no slivers or scrap has to be removed from between the fingers.

For best performance, the more contact fingers the better. Width of the beams on the odd and even number sides are slightly different to give equal deflection of the beam upon mating of the power meter blade.

The bus bar contacts of the present invention and many of their attendant advantages will be understood from the foregoing description. It is apparent that many changes may be made in the form, construction, an arrangement of parts thereof without departing from the spirit or scope of the invention, or sacrificing all of their material advantages.

What is claimed is:

1. A bus bar contact, comprising:

an integral one-piece body having two mating ends, one of the mating ends having a tab contact portion, the other of the mating ends having a receptacle contact portion, the receptacle contact portion having a plurality of resilient fingers for providing an electrical interface, the resilient fingers alternating successively along opposed sides of a mating slot with side edges of successive ones of the fingers being coplanar, and said body having parallel side edges between said tab contact portion and said receptacle contact portion, and said body having a constant conductive cross-sectional area between said tab contact portion and said receptacle contact portion.

2. The bus bar contact of claim 1, wherein the receptacle contact portion has an odd number of resilient contact fingers.

3. The bus bar contact of claim 2, wherein the combined width of the resilient fingers on one side of the slot is equal to the combined width of the resilient fingers on the opposite side of the slot.

4. The bus bar contact of claim 1, wherein the resilient fingers have protrusions along a contact interface.

5. The bus bar contact of claim 1, wherein adjacent resilient fingers are disposed on opposite.

* * * * *